US011806298B2

(12) United States Patent
Moten

(10) Patent No.: US 11,806,298 B2
(45) Date of Patent: Nov. 7, 2023

(54) KNEE PAIN REDUCTION STRAP

(71) Applicant: Wenona Moten, North Potomac, MD (US)

(72) Inventor: Wenona Moten, North Potomac, MD (US)

( * ) Notice: Subject to any disclaimer, the term of this patent is extended or adjusted under 35 U.S.C. 154(b) by 0 days.

(21) Appl. No.: 17/857,215

(22) Filed: Jul. 5, 2022

(65) Prior Publication Data

US 2023/0181406 A1 Jun. 15, 2023

Related U.S. Application Data

(60) Provisional application No. 63/288,929, filed on Dec. 13, 2021.

(51) Int. Cl.

| | |
|---|---|
| ***A63B 21/00*** | (2006.01) |
| ***A63B 23/035*** | (2006.01) |
| ***A61H 1/02*** | (2006.01) |

(52) U.S. Cl.

CPC ..... *A61H 1/0237* (2013.01); *A63B 21/00043* (2013.01); *A63B 21/4015* (2015.10); *A63B 23/03508* (2013.01); *A63B 21/4001* (2015.10); *A63B 21/4034* (2015.10); *A63B 21/4035* (2015.10); *A63B 21/4049* (2015.10)

(58) Field of Classification Search

CPC ..... A61H 1/0237; A63B 21/4001; A63B 21/4015; A63B 21/00043; A63B 21/04; A63B 21/0407; A63B 21/4013; A63B 21/4011; A63B 21/4033; A63B 21/4034; A63B 21/4035; A63B 21/4039; A63B 21/4049; A63B 23/08; A63B 23/085; A63B 23/0482; A63B 23/0494

See application file for complete search history.

(56) References Cited

U.S. PATENT DOCUMENTS

| | | | | |
|---|---|---|---|---|
| 5,230,679 | A * | 7/1993 | Olsen | A61H 1/0237 482/114 |
| 7,955,236 | B2 * | 6/2011 | DiGiovanni | A63B 21/0552 482/129 |
| 8,343,018 | B2 * | 1/2013 | Moulton | A63B 23/035 482/131 |
| 8,944,976 | B2 * | 2/2015 | Crowell | A63B 21/00043 482/121 |
| 11,213,418 | B2 * | 1/2022 | Knotts | A63B 23/02 |
| 11,229,277 | B1 * | 1/2022 | Davies | A63B 21/169 |
| 2011/0118094 | A1 * | 5/2011 | Kissner | A63B 21/00185 482/131 |
| 2013/0012368 | A1 * | 1/2013 | Verruto | A63B 21/0004 482/124 |
| 2016/0256732 | A1 * | 9/2016 | Kasner | A63B 23/1281 |
| 2018/0207046 | A1 * | 7/2018 | Doncaster | A61H 1/0237 |
| 2021/0299514 | A1 * | 9/2021 | Kim | A63B 21/4033 |

* cited by examiner

*Primary Examiner* — Megan Anderson

(74) *Attorney, Agent, or Firm* — Michael L. Greenberg, Esq.; Greenberg & Lieberman, LLC

(57) ABSTRACT

A knee pain reduction strap device is described. The device is configured to be used by a user alone who is experiencing knee pain. A primary strap is configured to be placed beneath the arch of the foot while a secondary strap, disposed atop the primary strap, helps to provide additional friction, and ensure that the device remains in position. Handles disposed on ends of the primary strap facilitate manipulation of the device by the user while in a sitting position to perform stretches of the ankle, calf, shin, and knee of the user, helping to alleviate pain over time.

1 Claim, 3 Drawing Sheets

KNEE PAIN REDUCTION STRAP

CONTINUITY

This application is a non-provisional application of provisional patent application No. 63/288,929, filed on Dec. 13, 2021, and priority is claimed thereto.

FIELD OF THE PRESENT INVENTION

The present invention relates to physical therapy and exercise devices, and more specifically relates to a strap configured to facilitate the reduction of knee pain and stress conventionally caused by injury and/or limping by working and stretching the ankles, shins, and knees in conjunction.

BACKGROUND OF THE PRESENT INVENTION

Knee injuries are common to individuals who have encountered exercise injuries, or those that have fallen. Knee pain is often a result which requires physical therapy to facilitate healing and alleviate the pain. It is known that individuals who have suffered from a knee injury commonly limp to minimize immediate pain when walking.

Unfortunately, the act of limping generally throws one's ankles, calves, and shins out of alignment, leading to a prolonging of the knee pain, as well as pain in other areas, such as the hips and lower back. Massage therapy and physical therapy are usually helpful, however it is generally crucial for the patient to continue the exercises on his or her own at home to maximize success. This is where many patients falter, as they fail to continue the exercises at home without assistance. If there were a device which could assist the individual in performing beneficial stretches and exercises at home on their own, knee pain could be reduced and/or eliminated faster with minimal intervention.

Thus, there is a need for a new form of knee pain reduction apparatus configured to facilitate the performance and execution of exercises and stretches of the shins, calves, and ankles which are conducive to the reduction and ultimate elimination of knee pain. Such an apparatus is preferably present in the form of a strap configured to remain disposed in communication with the arch of the foot of the user, the strap being equipped with handles to facilitate manipulation of the strap for the execution of beneficial stretches and exercises such as the "windshield wiper."

SUMMARY OF THE PRESENT INVENTION

The present invention is a knee pain reduction strap apparatus configured to facilitate the execution of stretches and exercises of the leg, including but not limited to the calves, shins, ankles, and knees. The apparatus is equipped with a primary strap and a secondary foot securing strap which is shorter than the primary strap. Handles are disposed on ends of the primary strap to facilitate manipulation and fine-tuned control of the strap by the user while in a sitting position. During use, the user pulls the handles in an oscillating manner to encourage a rolling of the foot from side-to-side, stretching and exercising muscles of the ankles and calves without necessitating the presence of another person such as a physical trainer.

The following brief and detailed descriptions of the drawings are provided to explain possible embodiments of the present invention but are not provided to limit the scope of the present invention as expressed herein this summary section.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

The present specification discloses one or more embodiments that incorporate the features of the invention. The disclosed embodiment(s) merely exemplify the invention. The scope of the invention is not limited to the disclosed embodiment(s).

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to effect such feature, structure, or characteristic in connection with other embodiments whether or not explicitly described.

Figure 1:
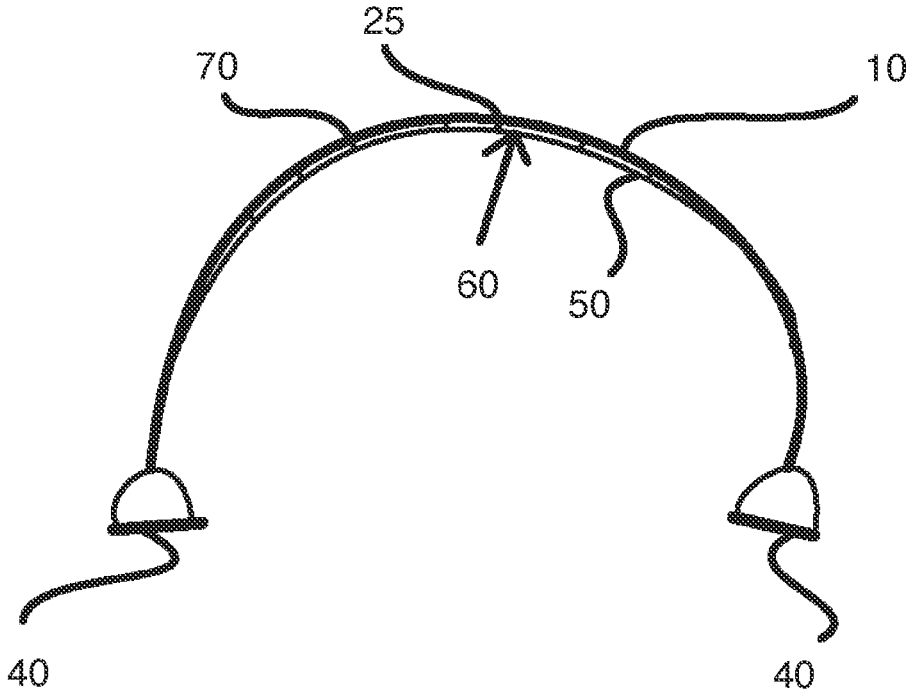
FIG. 1 depicts a view of the primary embodiment of the apparatus of the present invention as seen from the front.
Figure 2:
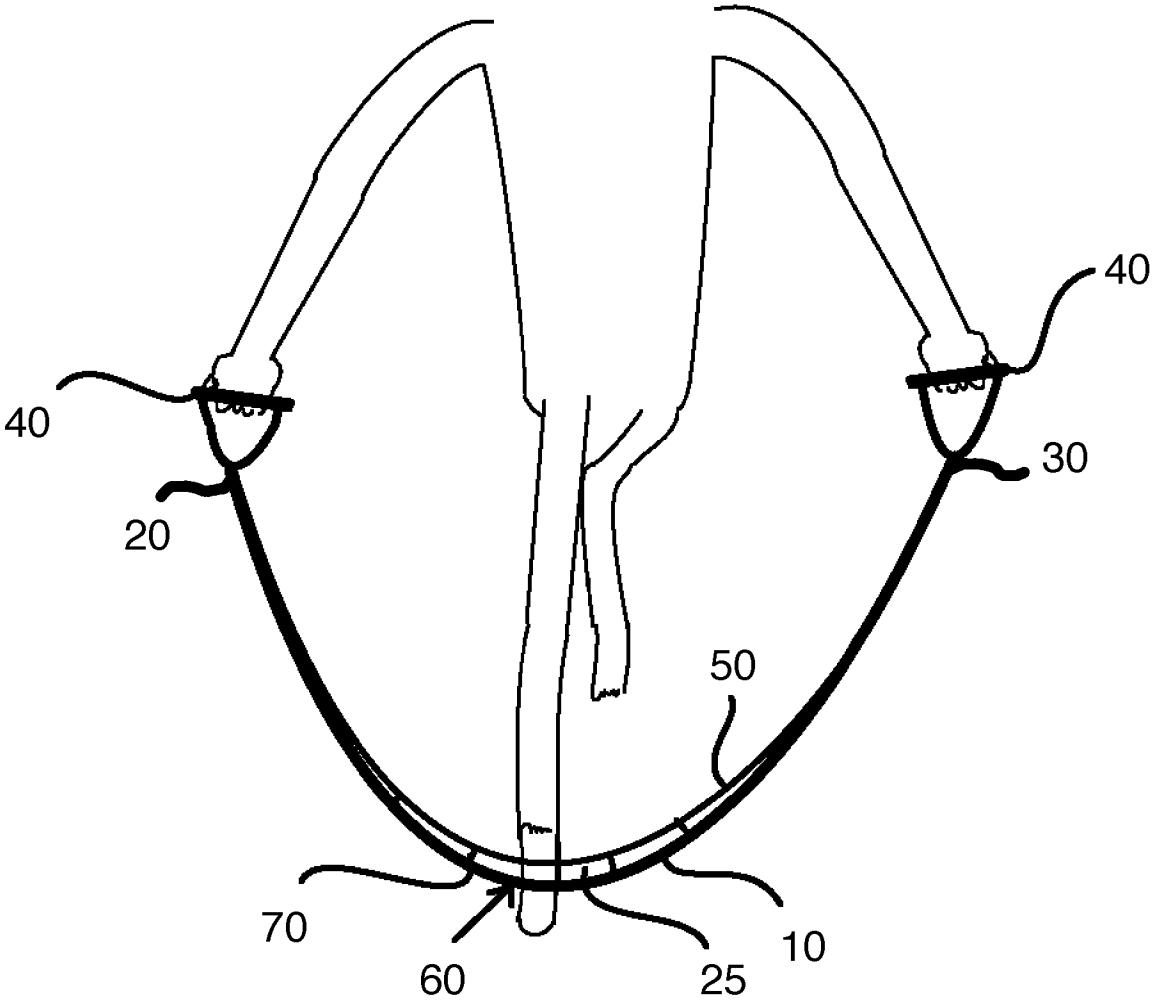
FIG. 2 depicts a view of the primary embodiment of the apparatus of the present invention, depicted in use by a user.

The present invention is a knee pain reduction apparatus configured to facilitate the execution of pain-reducing exercises and stretches by a user without assistance. The apparatus is embodied by a primary strap (10) having a first end (20) and a second end (30). Handles (40) are disposed in communication with the first end (20) and the second end (30) which are preferably padded for user comfort as depicted in FIG. 1.

A secondary strap (50) is disposed atop the primary strap (10), in the same plane, and is configured to function as a retaining strap to provide friction against the foot of the user. Combined, the secondary strap (50) and primary strap (10) create a primary loop (25) in which the user securely places his or her foot for use of the apparatus. As such, the secondary strap is preferably disposed at a center (60) of the primary strap (10), and is preferably affixed to the primary strap (10) via attachment means (70) such as fabric welds or adjustable/sliding buckles similar to those found on a bag or backpack strap. At least two iterations of attachment means (70) are present to form the primary loop (25) which is bounded by the primary strap (10) and the secondary strap (50).

Figure 3:
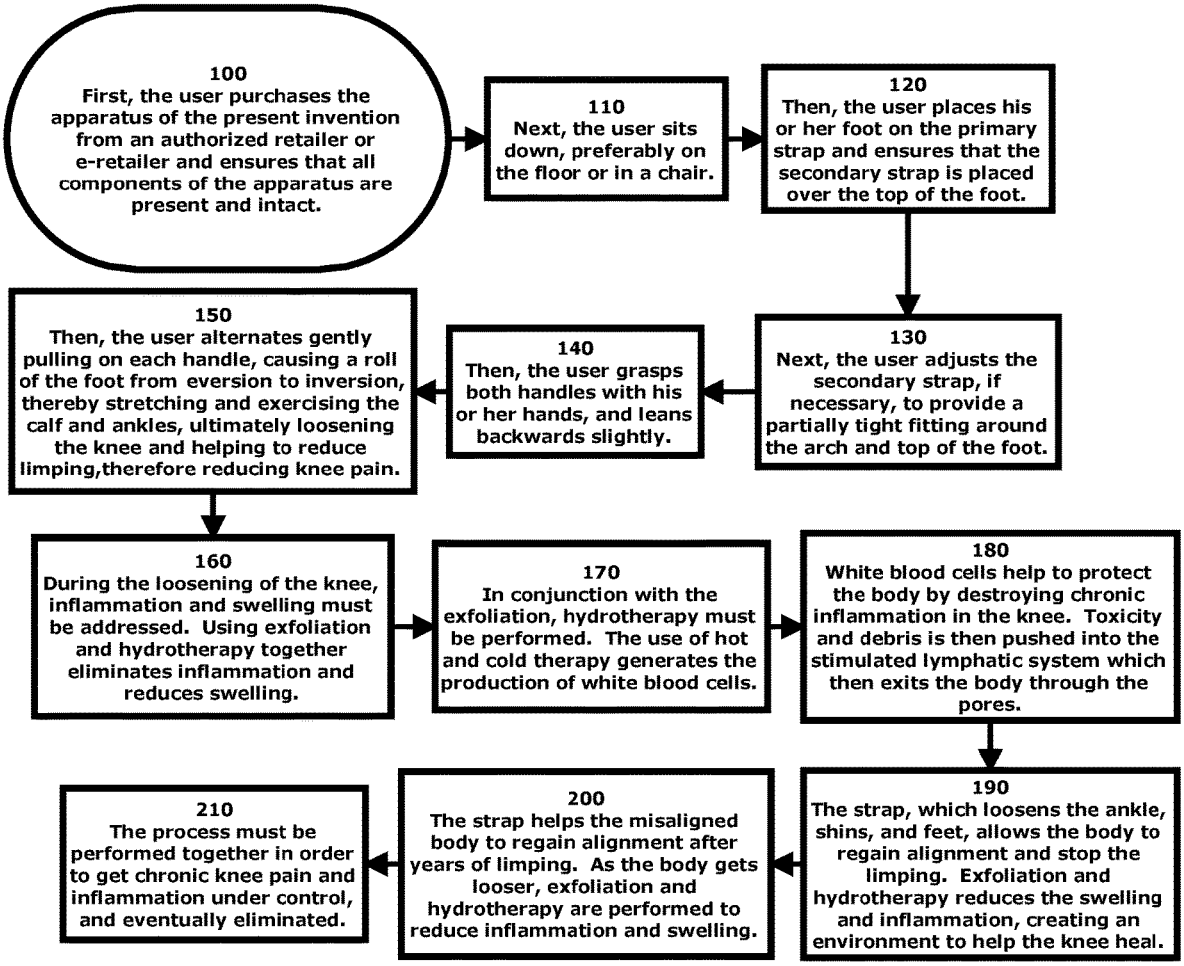
FIG. 3 depicts a flow chart detailing the process of use of the apparatus of the present invention by a user to perform stretching exercises.

The process of use of the apparatus of the present invention, as shown in FIG. 3, is preferably as follows:

1. First, the user purchases the apparatus of the present invention from an authorized retailer or e-retailer and ensures that all components of the apparatus are present and intact. (100)
2. Next, the user sits down, preferably on the floor or in a chair. (110)
3. Then, the user places his or her foot on the primary strap and ensures that the secondary strap is placed over the top of the foot. (120) It should be understood that the apparatus be placed on the foot of the leg afflicted with knee pain.
4. Next, the user adjusts the secondary strap, if necessary, to provide a partially tight fitting around the arch and top of the foot. (130)
5. Then, the user grasps both handles with his or her hands, and leans backwards slightly. (140)
6. Then, the user alternates gently pulling on each handle, causing a roll of the foot from eversion to inversion, thereby stretching and exercising the calf and ankles, ultimately loosening the knee and helping to reduce limping, therefore reducing knee pain. (150)
7. During the loosening of the knee, inflammation and swelling must be addressed. Using exfoliation and hydrotherapy together eliminates inflammation and reduces swelling. (160) Exfoliation is conducted via a glove, pad, or similar item. Exfoliation helps to stimulate the sluggish lymphatic system which has accumulated years of toxic waste built up from chronic knee pain.
8. In conjunction with the exfoliation, hydrotherapy must be performed. The use of hot and cold therapy generates the production of white blood cells. (170)
9. White blood cells help to protect the body by destroying chronic inflammation in the knee. Toxicity and debris is then pushed into the stimulated lymphatic system which then exits the body through the pores. (180)
10. The strap, which loosens the ankle, shins, and feet, allows the body to regain alignment and stop the limping. Exfoliation and hydrotherapy reduces the swelling and inflammation, creating an environment to help the knee heal. (190)
11. The strap helps the misaligned body to regain alignment after years of limping. As the body gets looser, exfoliation and hydrotherapy are performed to reduce inflammation and swelling. (200)
12. The process must be performed together in order to get chronic knee pain and inflammation under control, and eventually eliminated. (210)

Additionally, it should be noted that the preferred length of the strap (10) of the present invention is six feet, four inches in length, and is preferably composed of a durable woven nylon stretch strap exhibiting minimal, if any, elasticity. The strap (10) preferably exhibits six individual loops, with one primary loop (25) in which the foot of the user is placed during use.

The handles (40) of the present invention are preferably composed of cushioned foam and are outfitted with a non-slip material such that users with arthritis can easily hold the cushioned handles (40) without pain.

Alternate embodiments of the present invention may exhibit a shorter length of strap (10) which exhibits a wider or slimmer width in accordance with testing and user preference. Furthermore, it should be understood that the present invention is preferably available in a variety of colors, patterns, textures, and other design elements as integrated into the strap (10) itself and/or the handles (40).

Once a user has used the present invention for several sessions, the knee begins to loosen up. However, the user must deal with inflammation to facilitate full rehabilitation. To further enhance the healing process, a brush and/or textured glove to stimulate the congested lymphatic system. Without continued brushing/exfoliating, toxicity will build. Ideally, hydrotherapy with hot and then cold water is performed to open the pores and then the cold water stimulates the emergence of white blood cells which are directed to toxins, debris (dead blood cells, skin cells, etc.), and then the water is returned to hot water, opening the pores, and allowing the body to push out the toxins and debris. This process is repeated multiple times to open and close the pores of the body to motivate the lymphatic system to move the debris and toxins from the areas, helping to reduce and ultimately remove the inflammation. The use of hydrotherapy in the process of the present invention is critical to the long-term benefit, including eventual eliminated inflammation, maximizing the advantages of the exercises facilitated via the strap of the present invention.

In addition to exfoliation, the user may employ massage to facilitate lymphatic drainage to further activate the lymphatic system. Usually, people with knee pain have a congested lymphatic system. The massage, as with the hydrotherapy and exfoliation, helps to bring out white blood cells and rid the system of debris and toxins.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A method of reducing knee and hip pain of a user comprising:

extending a knee pain reduction strap laterally in front of the user while the user is in a sitting position;

wherein the knee pain reduction strap is equipped with a first end having a first handle and a second end having a second handle;

wherein the knee pain reduction strap has a primary strap overlaid with a secondary strap;

wherein the secondary strap is connected to the primary strap via fabric welds and stitching forming a primary loop bounded by the primary strap and the secondary strap;

inserting a foot of the user into the primary loop, the foot is of a leg with a knee afflicted with knee pain;

adjusting the secondary strap such that the primary loop provides a secure fitting around an arch and a top of the foot;

grasping both the first handle and the second handle;

leaning backwards; and alternating pulling on the first handle, then the second handle, causing a roll of the foot from eversion to inversion, thereby stretching and exercising the calf and ankles to ultimately loosen the knee.

* * * * *